US007562485B2

(12) United States Patent
Newhall et al.

(10) Patent No.: US 7,562,485 B2
(45) Date of Patent: Jul. 21, 2009

(54) APPARATUS AND METHOD FOR COUPLING AN AUXILIARY DEVICE WITH A MALE DOVETAIL RAIL

(75) Inventors: Thomas A. Newhall, Tucson, AZ (US); Mark A. Newhall, Tucson, AZ (US)

(73) Assignee: GG & G, Inc., Tucson, AZ (US)

( * ) Notice: Subject to any disclaimer, the term of this patent is extended or adjusted under 35 U.S.C. 154(b) by 539 days.

(21) Appl. No.: 11/270,056

(22) Filed: Nov. 9, 2005

(65) Prior Publication Data

US 2006/0117636 A1 Jun. 8, 2006

Related U.S. Application Data

(60) Provisional application No. 60/626,177, filed on Nov. 9, 2004.

(51) Int. Cl.
*F41G 1/38* (2006.01)

(52) U.S. Cl. ..... 42/127; 42/124; 42/148

(58) Field of Classification Search ..... 42/124–127, 42/148

See application file for complete search history.

(56) References Cited

U.S. PATENT DOCUMENTS

| | | | |
|---|---|---|---|
| 1,549,632 | A | 8/1925 | Trester |
| 1,837,290 | A | 12/1931 | Redfield |
| 2,187,054 | A | 1/1940 | Redfield |
| 2,306,972 | A | 12/1942 | Meisel |
| 2,580,246 | A | 12/1951 | Schall |
| 2,641,057 | A | 6/1953 | Moore |
| 2,782,507 | A | 2/1957 | Fallon |
| 2,810,963 | A | 10/1957 | Harper |
| 3,276,377 | A | 10/1966 | Bell |
| 3,785,603 | A | 1/1974 | Apel |
| 3,877,166 | A | 4/1975 | Ward |
| 3,880,389 | A | 4/1975 | Burris |
| 4,085,511 | A | 4/1978 | Kovac |
| 4,205,473 | A | 6/1980 | Wilson |
| 4,249,315 | A | 2/1981 | Hopson, III |
| 4,310,980 | A | 1/1982 | Pilkington |
| 4,574,508 | A | 3/1986 | Ross |
| 4,665,622 | A | 5/1987 | Idan |
| 4,722,496 | A | 2/1988 | Herrmann |
| 4,799,325 | A | 1/1989 | Booze |
| 4,835,895 | A | 6/1989 | Bowen |
| 4,845,871 | A | 7/1989 | Swan |
| 4,905,396 | A | 3/1990 | Bechtel |
| 5,086,566 | A | 2/1992 | Klumpp |
| 5,276,988 | A | 1/1994 | Swan |
| 5,570,529 | A | 11/1996 | Amelino |
| 5,680,725 | A | 10/1997 | Bell |

(Continued)

*Primary Examiner*—Michael Carone
*Assistant Examiner*—Gabriel J Klein
(74) *Attorney, Agent, or Firm*—Lawrence R. Oremland, P.C.

(57) ABSTRACT

A new and useful structure and method are provided that enable a coupling device to be integrated with an auxiliary device and to be effectively operated to securely couple the auxiliary device to a male dovetail rail (e.g. the male dovetail rail of a firearm). In addition, the structure and method of the present invention are designed to provide a range of adjustment over which the coupling structure can be effectively operated. Thus, the coupling structure can take up a range of tolerance variations in the manufacture of the male dovetail rail.

11 Claims, 4 Drawing Sheets

U.S. PATENT DOCUMENTS

| | | | |
|---|---|---|---|
| 5,787,630 | A | 8/1998 | Martel |
| 6,012,376 | A | 1/2000 | Hanke et al. |
| 6,606,813 | B1 | 8/2003 | Squire |
| 6,637,144 | B2 | 10/2003 | Nelson |
| 6,851,214 | B2 | 2/2005 | Oz |
| 6,874,269 | B2 | 4/2005 | Chen |
| 6,931,778 | B1 | 8/2005 | Nelson |

CROSS SECTION - LOCK POSITION

APPARATUS AND METHOD FOR COUPLING AN AUXILIARY DEVICE WITH A MALE DOVETAIL RAIL

RELATED APPLICATION/CLAIM OF PRIORITY

This application is related to and claims priority from provisional application Ser. No. 60/626,177, filed Nov. 9, 2004, which provisional application is incorporated by reference herein.

BACKGROUND

The present invention relates to apparatus and method for quickly and accurately coupling and uncoupling an auxiliary device to a second device that has a male dovetail rail, while retaining precision alignment of the auxiliary device.

It is known to provide a device such as a firearm with a male dovetail rail that can be used for coupling an auxiliary device (e.g. an auxiliary sight). In the applicants' experience, such coupling structures are generally formed as an integral part of the auxiliary device, or are manufactured and made an integral part of a separate mounting device for an auxiliary device. In addition, such coupling devices require special or ancillary tools (or may require the use of coins) to attach or detach the coupling devices. Moreover, the type of mechanism used in such coupling devices often times vibrate loose due to recoil, or can result in loose component parts that can detach from the firearm and can be either dropped or lost.

In addition, performing coupling or uncoupling of an auxiliary device from a device such as a firearm can be noisy. Additionally, present coupling devices do not lend themselves to be attached or detached from a male dovetail rail in adverse weather, such as cold, wet, or snowy conditions where wearing gloves is necessary. Still further, most coupling devices are not capable of being repeatedly coupled and uncoupled to a support such as a male dovetail rail, which may pose limits on the use of the auxiliary device. For example, it may be necessary to quickly remove an auxiliary device due to device failure, or the need to replace one device with another for a specific task. Or, in order to acquire the most beneficial mounting position of an auxiliary device for serviceability or comfort, it is often necessary to re-position the auxiliary device along multiple installation points along a male dovetail. All of the foregoing examples require the coupling device to be uncoupled and re-coupled many times. Existing coupling devices, upon several coupling and uncoupling cycles tend to loose their ability to obtain and retain a high level of precision alignment. Still further, many coupling devices that may be quickly attached and de-attached are not robust enough in design and manufacture to withstand abuse and potential misalignment of the auxiliary device.

Applicants believe there is a need for a coupling structure and method that can be integrated into an existing auxiliary device, and provide a highly efficient, accurate and secure structure and method to quickly and silently couple the auxiliary device to and uncouple the auxiliary device from a male dovetail rail.

In addition, in applicants' experience, male dovetail rails, if not made to precise specifications, can have tolerance variations which need to be effectively taken up, in order to securely and accurately couple an auxiliary device to the male dovetail rail.

SUMMARY OF THE PRESENT INVENTION

The present invention provides a unique, new and useful structure and method that address the foregoing issues. The structure and method enable a coupling device to be integrated into an auxiliary device (e.g. an auxiliary device for a firearm), and which can provide a highly efficient, accurate and secure structure and method to quickly and silently couple and uncouple the auxiliary device to a male dovetail rail.

A particularly useful feature of the principles of the present invention is that the structure and method enables an assembly of components to be used to retrofit a coupling device to an auxiliary device, and in a manner that addresses the foregoing issues.

The preferred embodiment of the present invention is also unique in that it is finger operated and does need ancillary tools or coins to couple or uncouple the auxiliary device from the male dovetail rail. The structure is configured such that it is virtually impossible to release accidentally.

In addition, the structure and method of the present invention is designed to provide a range of adjustment over which the coupling structure can be effectively operated. Thus, the coupling structure can take up a range of tolerance variations in the manufacture of the male dovetail rail.

The principles of the present invention, while applicable to a number of auxiliary devices, are particularly useful for coupling an auxiliary device to a male dovetail rail of a firearm. Such an auxiliary device might be, e.g., an optical scope, flashlight, laser fire control device, night vision and thermal sights, sensor, communication device, grenade launcher, and or other quickly attached ancillary devices.

Also, in this application, reference to a coupling being "integrated with" "integrated into" or "integrally formed with" an auxiliary device or "integrating coupling structure into an auxiliary device" means that (i) the auxiliary device may be first formed as an article of manufacture, and the coupling is assembled with the formed auxiliary device (e.g. as a retrofit or to form a new article of manufacture), or (ii) the coupling is manufactured into and made an integral part of a separate mounting system for an auxiliary device, or (iii) the coupling is assembled with (into) the auxiliary device as the auxiliary device is being assembled, so that the auxiliary device and coupling comprise an article of manufacture.

Moreover, reference to "coupling characteristics" of a coupling that is integrated into an auxiliary device means the capability of the coupling to enable connection and/or disconnection of the auxiliary device (or a mounting systems for the auxiliary device) from a male dovetail rail.

In addition, the words "coupling" and "decoupling" may be used interchangeably with words like "connecting" and "disconnecting", "attaching" and "detaching" or "mounting" and "unmounting".

Additional features of the present invention will become further apparent from the following detailed description and the accompanying drawings.

DETAILED DESCRIPTION

As discussed above, the present invention provides a structure and method that is integrated into an auxiliary device in a manner that enables the auxiliary device to be quickly, accurately and securely coupled and uncoupled with a male dovetail rail without the use of ancillary tools or coins, and provides for accurate (i.e. within one half minute of angle (M.O.A)) positioning of the auxiliary device when re-coupled with the dovetail rail. The principles of the present invention are described below in connection with an example of a retrofit for an auxiliary sight device comprising an optical scope for a firearm. However, from that description, the manner in which the principles of the present invention can be used to integrate coupling structure with various types of auxiliary devices (e.g. for firearms) will be apparent to those in the art.

Figure 1:
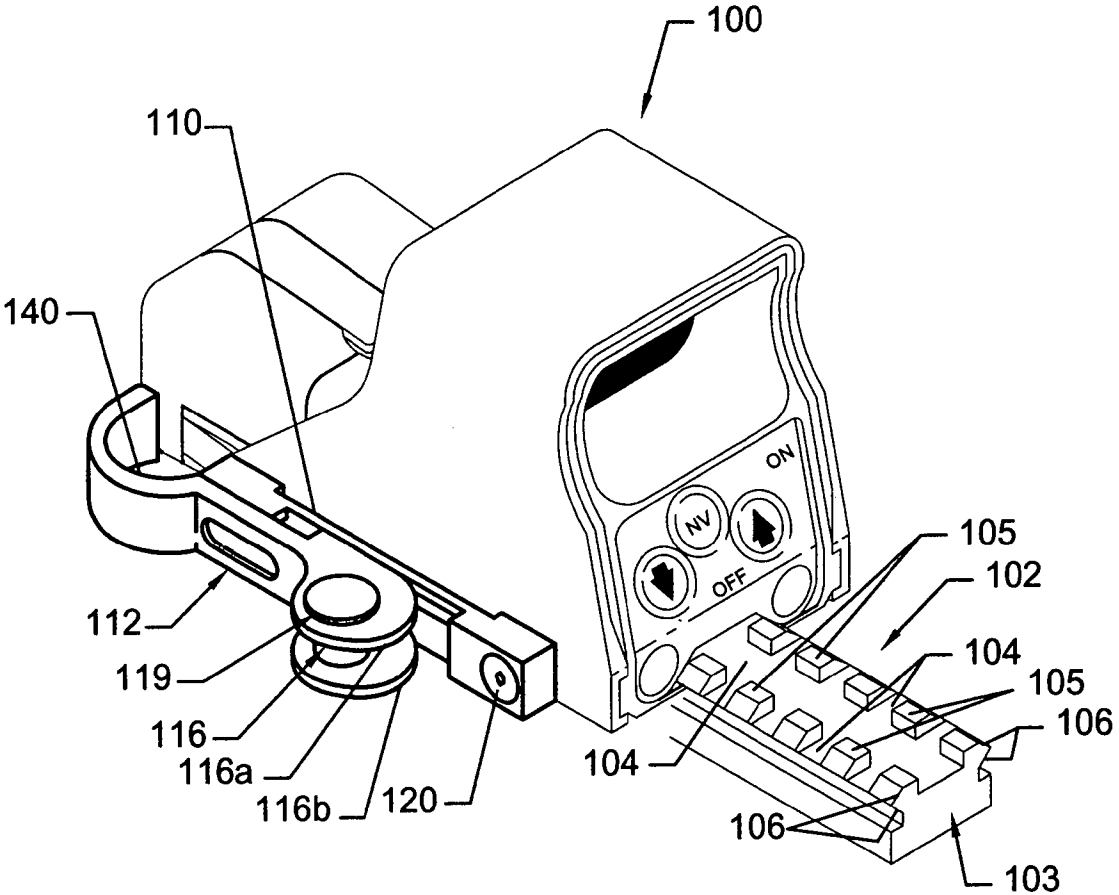
FIG. 1 is a schematic three dimensional illustration of an auxiliary sight device that is coupled to a male dovetail rail, according to the principles of the present invention.

FIG. 1 schematically illustrates an auxiliary sight device 100 coupled with a male dovetail rail 102. The male dovetail rail 102 is connected to a firearm in many ways and configurations, or is manufactured as an integral part of a firearm (not shown) and provides a convenient mounting base for an auxiliary device that is intended to be coupled with the firearm. The auxiliary sight device 100 is illustrated as an optical scope, but it is contemplated that the auxiliary device can comprise any type of device that can be attached to a firearm, to provide some form of illumination, sighting or other auxiliary capability for the operator of the firearm. Some examples of auxiliary devices are optical scopes, flashlights, laser fire control devices, night vision and thermal sights, sensors, communication devices, grenade launchers, and or other quickly attached devices.

The male dovetail rail 102 has a support rail 103 with a plurality of facing, rectangular notches that form recoil slots 104 in the top of the dovetail rail 102. These recoil slots extend transversely across the top of the dovetail rail, result in the formation of a series of recoil lugs 105 in the mail dovetail rail 102. The support rail 103 also includes a pair of male dovetails 106 extending along opposite sides of the support rail, and in spaced apart relationship on the support rail. The mail dovetails 106 enable an auxiliary device to be coupled to the male dovetail rail 102, with at least a cross piece of the coupling structure disposed in a recoil cross slot 104 in the male dovetail rail. In the illustrated embodiment, the coupling structure includes a recoil locking cross bolt 114 (described below) that extends below and crosswise to the coupling device and dovetail rail which allows it to project into the recoil cross slot 104 of the dovetail rail and engage a recoil lug 105 when the auxiliary sight device 100 is coupled with the male dovetail rail 102.

Figure 4:
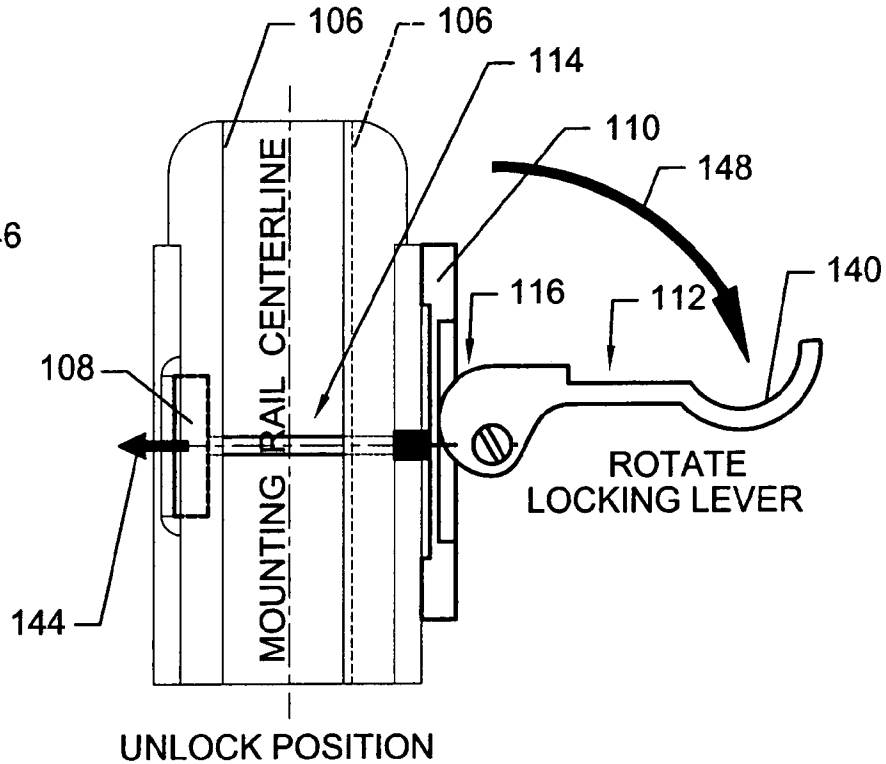
FIGS. 3 and 4 are schematic bottom views of an auxiliary sight device with coupling structure according to the present invention, and illustrating the coupling device in its lock and unlocked positions, respectively.
Figure 3:
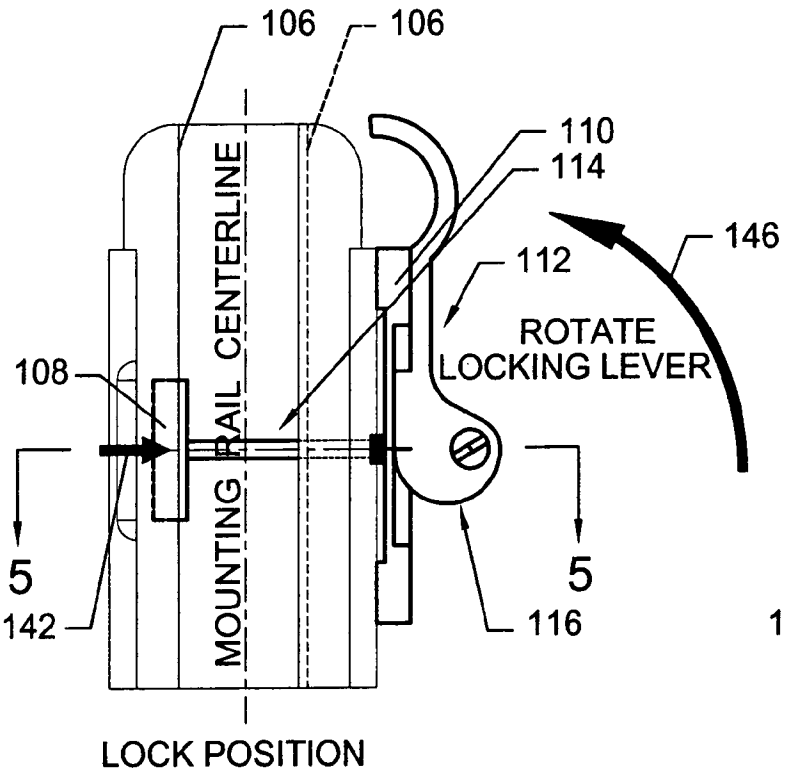
Figure 5:
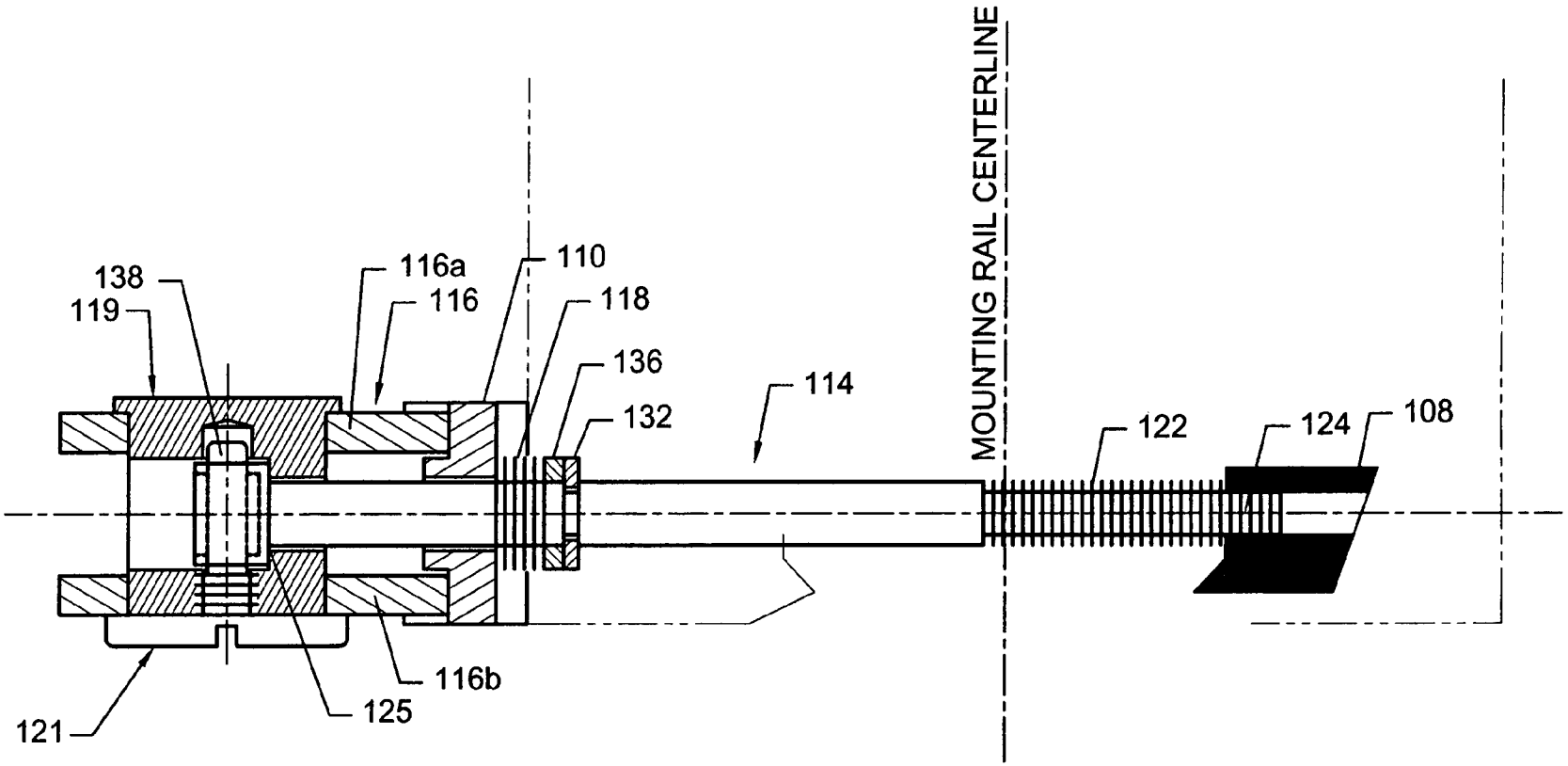
FIG. 5 is a cross sectional view of the coupling structure of FIG. 3, taken from the direction 5-5.

As seen particularly from FIGS. 2-5, the coupling structure comprises (a) a movable side clamping bar 108 and a flex bar 110 disposed on opposite sides of the auxiliary sight device 100, (b) a cam lever 112 with grooved finger slot 140 that is pivotal relative to the flex bar 110, and (c) a recoil locking cross bolt 114 that is connected with the movable side bar, flex bar and cam lever in a manner such that (i) pivotal movement of the cam lever 112 in one direction (i.e. the direction shown by arrow 146 in FIG. 3) initiates a slight deformation in the flex bar, drawing the recoil locking cross bolt along a linear path thus drawing the movable side bar 108 toward the flex bar (as seen by arrow 142) which causes the movable side bar 108 to securely engage the mating surface of one of the long edges of the male dovetail rail 102 (FIG. 3), to couple the auxiliary sight device with the male dovetail rail, and (ii) pivotal movement of the cam lever 112 in an opposite direction (i.e. as shown by arrow 148 in FIG. 4) initiates a slight deformation in the flex bar, moves the recoil locking cross bolt 114 in linear path away from the flex bar, which in turn moves the movable side bar 108 away from the flex bar and from the long edge of the dovetail rail 102 (see arrow 144), thus disengaging the mating surfaces of the movable side bar and the dovetail rail, enabling the auxiliary sight device 100 to be quickly uncoupled or detached from the dovetail rail 102 (FIG. 4). In essence, movement of the cam lever 112 to the lock position (FIG. 3) pulls the movable side bar 108 toward the flex bar 110 (see arrow 142), and movement of the cam lever 112 to the unlock position (FIG. 4) pushes the movable side bar 108 away from the flex bar 110 (see arrow 144).

A camming device 116 is preferably formed in one piece with the cam lever 112. The camming device 116 preferably comprises a pair of spaced apart cam members 116*a*, 116*b*. The camming device 116 is rotated in a manner such that it acts on the flex bar 110, initiates a slight deformation of the flex bar, and causes the movable side bar 108 to be pushed away from the flex bar 110 as the coupling device is unlocking the auxiliary sight device 100 from the male dovetail rail 102. As the cam lever 112 is pivoted to a locking position (FIG. 3), the camming device 116 pivots in a manner that overcomes the tension of a retention spring 118 (described below) that acts between the flex bar 110 and an E-clip 132 (also described below), initiates a slight deformation of the flex bar, and thereby effectively pulls the movable side bar 108 toward the flex bar 110.

Figure 2:
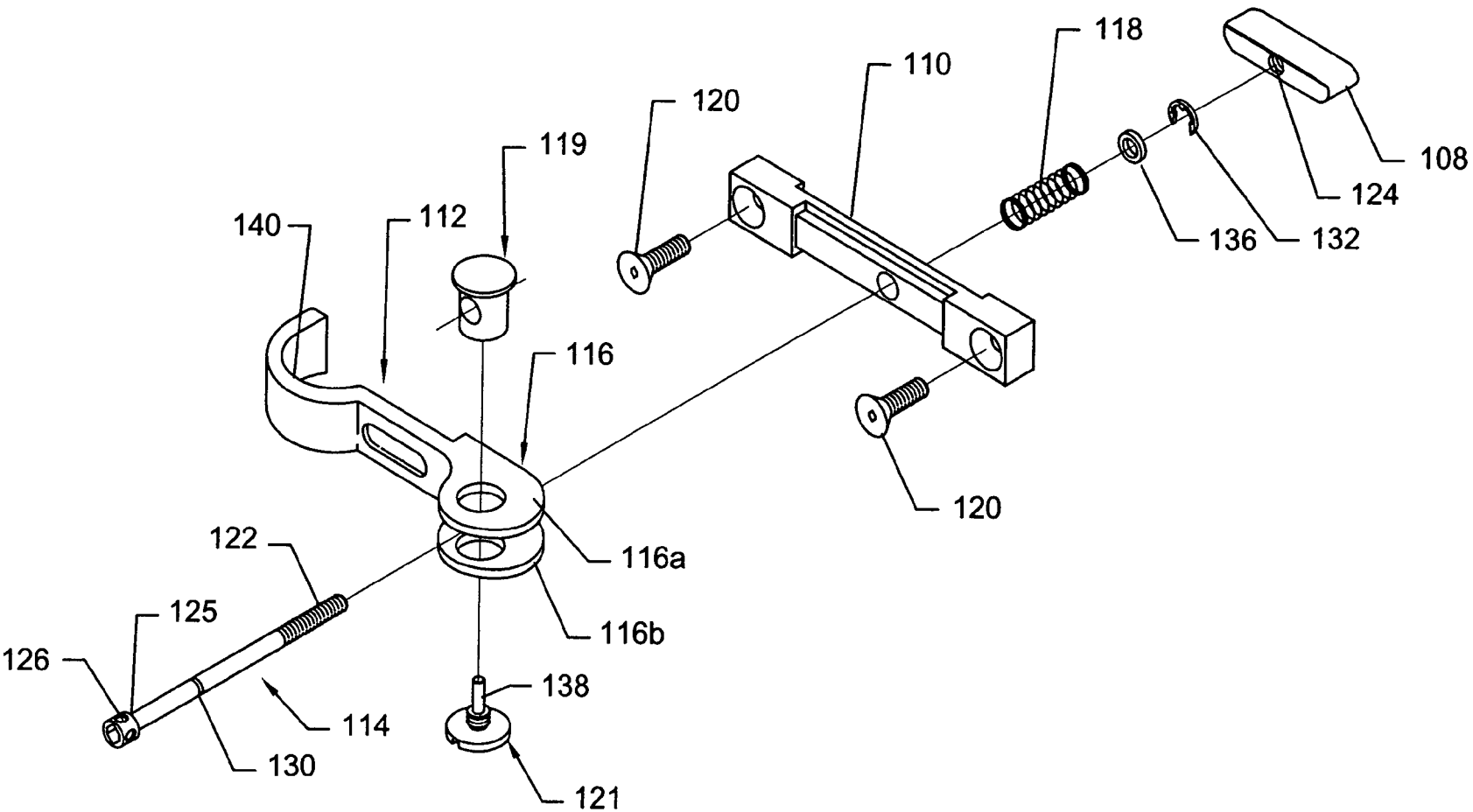
FIG. 2 is an exploded view of the components forming a coupling device according to the principles of the present invention.

The components of the coupling device can be seen from FIG. 2. The opposite ends of the flex bar 110 are fixedly connected to the auxiliary sight device 100 by screws 120. The cam lever 112 is pivotal on a pivot mechanism formed by a cam pivot 119 that extends through the cam 116, and is coupled with a pivot lock 121. The recoil locking cross bolt 114 has a threaded end 122 that engages a threaded recess 124 in the movable side bar 108, a locking head 125 with a plurality of adjustment holes 126 (four such holes are illustrated), and a groove 130 into which an E-clip 132 is disposed. The retention spring 118 is located on the recoil cross bolt 114, and acts between the E-clip 132 and one side of the flex bar (a retaining washer 136 is located between the spring and the E-clip). When the cam lever 112 is in the unlocked position, the retention spring 118 causes tension between the washer 136 and the inside face of the flex bar 110 which cause the recoil locking cross bolt to retain an "open" position, this in turn keeps the movable side bar 108 away from the mating engagement surface of the male dovetail rail. This allows the auxiliary device 100 to easily be removed or reinstalled without having to attempt to manually move the movable side bar to an "open" position.

As the coupling structure is being assembled with the auxiliary sight device, recoil locking cross bolt 114 is located with its head 125 between the cam members 116*a*, 116*b*. Recoil locking cross bolt 114 is rotated so that one of the adjustment holes 126 is aligned with a shaft 138 formed in one piece with the pivot lock 121, so that as the pivot lock 121 is coupled with the cam pivot 119, the shaft 138 extends through the hole 126 that is aligned with the shaft. This has the effect of adjusting the compression of the retention spring 118 and also the amount that the flex bar 110 will flex under the operation of the cam 116, as the opposing counter force is generated as the movable side bar engages the mating surface of the dovetail rail. This also effectively determines the range of movement of the flex bar 110 and movable side bar 108 toward and away from each other during locking and unlocking of the coupling. Thus, the coupling device enables relative movement of the movable side bar and flex bar over a range that will take up a range of tolerance variations that may be introduced into the male dovetail rail during its manufacture.

As will be appreciated by those in the art, the foregoing coupling structure can be conveniently retrofit to an existing auxiliary sight device. A typical auxiliary sight device 100 will have a fixed side and a movable side bar 108 as part of its structure, and the other components shown in FIG. 2 are provided and are retrofit to the auxiliary sight device to enable the auxiliary sight device to be coupled with a male dovetail rail. If the movable side bar 108 does not already have a threaded bore for the recoil locking cross bolt, the threaded bore can be provided in the movable side bar. The recoil locking cross bolt 114 is inserted though the cam 116 and the flex bar 110, and the cam pivot 119 and cam 116 are coupled with the cam lever 112 and the recoil locking cross bolt 114, by inserting the shaft 138 on the cam pivot 121 through a selected hole 126 in the recoil locking cross bolt 114. The retention spring 118, E-clip 132 and retaining washer 136 are then assembled with the recoil locking cross bolt 114. The recoil locking cross bolt 114 is then engaged with the movable side bar 108, and the flex bar 110 is coupled to the side of the auxiliary sight device 100. The selected one of the holes 126 in the head 125 of the recoil locking cross bolt through which the cam pivot shaft 138 extends effectively sets the tension in the retention spring 118 and selectively adjusts the amount of flex of the flex bar 110 as it is acted upon by the cam 116 as the coupling is being unlocked from the male dovetail rail 102. The amount of flex effectively determines the range of movement of the flex bar 110 and movable side bar 108 toward and away from each other, and thereby provides some range of tolerance in the male dovetail rail that can be taken up by the coupling structure of the present invention.

It should also be noted that the cam lever 112 includes a finger slot 140 that is formed in one piece with the cam lever 112 and is shaped to be conveniently engaged by an operator's index finger. Grooves are provided on the interior face of the finger slot 140 so as to provide a non-slip surface. This enables an operator to conveniently pivot the cam lever 112 from a locked to an unlocked position. The size and shape of this finger slot are large enough to allow the operator to perform this task with a gloved finger.

Also, it should be noted that the components of the coupling device are preferably formed of steel, but it is also contemplated that lighter weight metals or synthetic materials (e.g. moldable synthetic resin) may also be used.

Additionally, it should be noted that the coupling device of the present invention provides a single flex bar and single movable side bar on opposite sides of the auxiliary sight device, and the flex bar on the same side of the auxiliary sight device as the cam lever. Moreover, the provision of the single retention spring, E-clip and adjustable recoil locking cross bolt, and the manner in which those components are assembled with and interact with the cam lever and flex bar, enables the amount of tension on the flex bar, and relative movement of the flex bar and movable side bar relative to each other to be selectively adjusted, to enable the coupling device to operate over a range of tolerance variations in the male dovetail rail.

Accordingly, the foregoing disclosure provides structure and method for integrating a coupling device with an auxiliary device (e.g. for a firearm), such that the auxiliary device can be efficiently and effectively coupled with or uncoupled from a male dovetail rail. The coupling structure comprises a movable side bar and a flex bar in facing but spaced relationship, a cam lever that is pivotal relative to the flex bar, and a recoil locking cross bolt connected with the movable side bar, flex bar and cam lever in a manner such that (i) pivotal movement of the lever in one direction initiates a slight deformation in the flex bar, moving the recoil locking cross bolt in a linear direction toward the flex bar and drawing the side bar toward the flex bar, which causes the movable side bar to engage the mating surface of one of the long edges of the male dovetail rail in order to couple the auxiliary device with the male dovetail rail, and (ii) pivotal movement of the cam lever in an opposite direction initiates a slight deformation in the flex bar, moves the recoil locking cross bolt in a linear direction away from the flex bar, which in turn moves the movable side bar away from the long edge of the dovetail rail, thus disengaging the mating surfaces of the movable side bar and the dovetail rail, enabling the auxiliary sight device to be uncoupled from the male dovetail rail. The structure and method of the present invention is designed to provide a range of adjustment over which the coupling structure can be effectively operated. Thus, the coupling structure can take up a range of tolerance variations in the manufacture of the male dovetail rail.

It should also be noted that while the foregoing description relates to a coupling structure that is integrated into the auxiliary device, the principles of the present invention are also useful in integrating the coupling structure into a mounting system for an auxiliary device. For example, a mounting system for an optical sight for a firearm can be configured to be coupled with or uncoupled from a male dovetail rail, by the structure and method described above, and an auxiliary device such as an optical sight can, in turn, be connected with the mounting system.

With the foregoing disclosure in mind, the manner in which the principles of the present invention can be used to integrate coupling structure into various types of auxiliary devices will be apparent to those in the art.

What is claimed is:

1. Apparatus comprising a. a male dovetail rail, b. an auxiliary device, and c. coupling structure integrated with the auxiliary device in a manner that enables the auxiliary device to be selectively coupled with the male dovetail rail or uncoupled from the male dovetail rail;

d. the coupling structure comprising a side bar and a flex bar in facing but spaced relationship, a cam lever that is pivotal relative to the flex bar, and a recoil locking cross bolt connected with the side bar, flex bar and cam lever in a manner such that (i) pivotal movement of the cam lever in one direction initiates a bend in the flex bar, draws the side bar towards the dovetail rail, and establishes and maintains mating surfaces between the side bar and dovetail rail, enabling the auxiliary device to be coupled to the male dovetail rail, and (ii) pivotal movement of the lever in an opposite direction initiates a slight bend in the flex bar, moves the side bar away from the dovetail rail, enabling the auxiliary sight device to be uncoupled from the male dovetail rail.

2. Apparatus for use in coupling an auxiliary device with a male dovetail rail, comprising a. coupling structure that can be integrated with an auxiliary device in a manner such that the coupling structure can enable the auxiliary device to be selectively coupled with or uncoupled from a male dovetail rail;

b. the coupling structure comprising a side bar and a flex bar configured to be disposed on opposite sides of the auxiliary device, a cam lever that is pivotal relative to the flex bar, and a recoil locking cross bolt connected with the side bar, flex bar and lever in a manner such that (i) pivotal movement of the lever in one direction initiates a bend in the flex bar, draws the side bar towards the flex bar, and establishes and maintains engagement between the side bar and the dovetail rail, and (ii) pivotal movement of the lever in an opposite direction initiates a bend in the flex bar, moves the side bar away from the dovetail rail, thus enabling the auxiliary sight device to be uncoupled from the male dovetail rail.

3. Apparatus for use in coupling an auxiliary device of a type that includes a side bar with a male dovetail rail, comprising a. coupling structure that can be integrated with an auxiliary device in a manner such that the coupling structure can enable the auxiliary device to be selectively coupled with or uncoupled from a male dovetail rail;

b. the coupling structure comprising a flex bar configured to be disposed on an opposite side of the auxiliary device as the side bar, a cam lever that is pivotal relative to the flex bar, and a recoil locking cross bolt configured to be connected with the flex bar, the lever and the side bar of the auxiliary device in a manner such that (i) pivotal movement of the lever in one direction initiates a bend in the flex bar, draws the side bar towards the flex bar, and establishes and maintains engagement between the side bar and the dovetail rail, and (ii) pivotal movement of the lever in an opposite direction initiates a bend in the flex bar, moves the side bar away from the dovetail rail, thus enabling the auxiliary sight device to be uncoupled from the male dovetail rail.

4. A method for integrating coupling structure into an auxiliary device to enable the auxiliary device to be selectively coupled and uncoupled with a male dovetail rail, comprising the steps of a. providing a side bar and a flex bar configured to be positioned on opposite sides of the auxiliary device, and a cam lever that is pivotal relative to the flex bar, and b. connecting a recoil locking cross bolt with the side bar, flex bar and cam lever in a manner such that (i) pivotal movement of the lever in one direction initiates a bend in the flex bar, moves the side bar towards the flex bar, and establishes and maintains engagement between the side bar and the male dovetail rail, to enable the auxiliary device to be coupled to the male dovetail rail, and (ii) pivotal movement of the lever in an opposite direction initiates a bend in the flex bar, moves the side bar away from the flex bar, thus enabling the auxiliary device to be uncoupled from the male dovetail rail.

5. A method for integrating coupling structure into an auxiliary device, comprising the steps of a. providing components for forming an auxiliary device, and b. integrating coupling structure into the auxiliary device in a manner that enables the auxiliary device to be coupled to a male dovetail rail;

c. the coupling structure including a side bar, flex bar, moveable lever with a cam that acts on the flex bar, a recoil locking bolt and a retention spring that biases the side bar away from the flex bar, and d. the coupling characteristics of the coupling being configured to enable the cam to selectively act on the flex bar in a manner that (i) initiates a bend in the flex bar, pulls the side bar toward the flex bar, and establishes and maintains engagement between the side bar and the male dovetail rail or (ii) releases at least some tension on the flex bar and enables the retention spring to push and maintain the side bar away from the flex bar.

6. Apparatus comprising a. an auxiliary device, and b. coupling structure integrated with the auxiliary device in a manner that enables the auxiliary device to be selectively coupled with or uncoupled from a male dovetail rail;

d. the coupling structure comprising a side bar and a flex bar in facing but spaced relationship, a cam lever that is pivotal relative to the flex bar, and a recoil locking cross bolt connected with the side bar, flex bar and cam lever in a manner such that (i) pivotal movement of the cam lever in one direction initiates a bend in the flex bar, draws the side bar towards the flex bar, and establishes and maintains engagement between the side bar and the male dovetail rail, enabling the auxiliary device to be coupled to a male dovetail rail, and (ii) pivotal movement of the lever in an opposite direction initiates a bend in the flex bar, moves the side bar away from the flex bar, enabling the auxiliary device to be uncoupled from a male dovetail rail.

7. Apparatus as defined in claim 2, wherein the flex bar is configured to enable the auxiliary device to be secured thereto, to enable the coupling structure to be integrated with the auxiliary device.

8. A method as defined in claim 4, including configuring the flex bar in a manner that enables an auxiliary device to be secured to the flex bar.

9. A method as defined in claim 5, including configuring the flex bar in a manner that enables an auxiliary device to be secured to the flex bar.

10. Apparatus as defined in claim 1, wherein the recoil locking cross bolt extends through a hole in the flex bar and through a hole in a cam pivot, the recoil locking cross bolt has threads at one end that enable the recoil locking cross bolt to engage a threaded opening in a side bar, and the other end of the recoil locking cross bolt has a head that is disposed between sides of the cam lever, and wherein the head of the recoil locking cross bolt has a plurality of openings that are located about its periphery such that pairs of the openings can be selectively aligned with openings in the sides of the cam lever in a selected orientation, and those pairs of openings can be maintained in the selected orientation by interconnection of a pivot lock with the cam pivot, each of which extends through the openings in the sides of the cam lever.

11. The method as defined in claim 5, wherein the coupling structure is configured such that the recoil locking cross bolt extends through a hole in the flex bar and through a hole in a cam pivot, the recoil locking cross bolt has threads at one end that enable the recoil locking cross bolt to engage a threaded opening in a side bar, and the other end of the recoil locking cross bolt has a head that is disposed between sides of the cam lever, and wherein the head of the recoil locking cross bolt has a plurality of openings that are located about its periphery such that pairs of the openings can be selectively aligned with openings in the sides of the cam lever in a selected orientation, and those pairs of openings can be maintained in the selected orientation by interconnection of a pivot lock with the cam pivot, each of which extends trough the openings in the sides of the cam lever.

* * * * *